US007395026B2

(12) United States Patent
Seo et al.

(10) Patent No.: US 7,395,026 B2
(45) Date of Patent: Jul. 1, 2008

(54) IMAGE FORMING APPARATUS HAVING AUXILIARY TRAY

(75) Inventors: In-Sick Seo, Suwon-si (KR); Yong-Whan Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 267 days.

(21) Appl. No.: 11/104,414

(22) Filed: Apr. 13, 2005

(65) Prior Publication Data

US 2005/0244204 A1 Nov. 3, 2005

(30) Foreign Application Priority Data

May 3, 2004 (KR) ..... 10-2004-0030934

(51) Int. Cl.
*G03G 15/00* (2006.01)
*B65H 31/20* (2006.01)
*B65H 31/26* (2006.01)

(52) U.S. Cl. ..... 399/405; 271/278; 271/207

(58) Field of Classification Search ..... None
See application file for complete search history.

(56) References Cited

FOREIGN PATENT DOCUMENTS

| | | | |
|---|---|---|---|
| JP | 61-93258 | | 6/1986 |
| JP | 62-8259 | | 1/1987 |
| JP | 4-60443 | | 5/1992 |
| JP | 07-315665 | | 12/1995 |
| JP | 08053253 | A * | 2/1996 |
| JP | 09-286556 | | 11/1997 |
| JP | 2003054821 | A * | 2/2003 |
| JP | 2004010220 | A * | 1/2004 |
| KR | 1020030083509 | | 10/2003 |

* cited by examiner

*Primary Examiner*—Daniel J. Colilla
*Assistant Examiner*—Wynn' Q Ha
(74) *Attorney, Agent, or Firm*—Roylance, Abrams, Berdo & Goodman, L.L.P.

(57) ABSTRACT

An image forming apparatus is provided having a printing unit including a detachable developer cartridge. The apparatus prints an image on a sheet using an electrophotographic process. A tray is provided to receive a sheet discharged after the completion of printing. An auxiliary tray is pivotably installed on the tray and has a first position folded over the tray and a second position to increase the length of the tray. The auxiliary tray pivots to the second position when the developer cartridge is mounted in the printing unit.

9 Claims, 6 Drawing Sheets

IMAGE FORMING APPARATUS HAVING AUXILIARY TRAY

CROSS-REFERENCE TO RELATED APPLICATIONS

This application claims the benefit under 35 U.S.C. § 119 (a) of Korean Patent Application No. 10-2004-0030934, filed on May 3, 2004, the entire disclosure of which is hereby incorporated by reference.

BACKGROUND OF THE INVENTION

1. Field of the Invention

The present invention relates to an image forming apparatus having a tray to receive a sheet discharged after the completion of printing. More particularly, the present invention relates to a tray to receive a discharged sheet that increases the length of the tray without enlarging the footprint of the image forming apparatus.

2. Description of the Related Art

Image forming apparatuses print an image on a surface or both surfaces of a sheet through a predetermined printing process. The apparatuses then discharge the sheet. An image forming apparatus typically has a tray to receive the discharged sheet. In order to reduce the footprint of the image forming apparatus, a top portion of the image forming apparatus is often used as the tray. As image forming apparatuses are minimized in size, the length of the tray is becoming shorter than the length of the sheet. Consequently, in many instances, the sheet is slipping off the tray. Accordingly, it is necessary to increase the length of the tray.

Japanese Patent Publication No. JP07-315665, the entire disclosure of which is hereby incorporated by reference, discloses a sheet stacker comprising a main stacker. The main stacker is installed on a printer body to rotate on a hinge. A rod-shaped auxiliary stacker is rotatably installed on the main stacker. When a short sheet is received, the auxiliary stacker is received in the main stacker. When a long sheet is received, the auxiliary stacker rotates away from the main stacker.

Japanese Publication No. JP04-60443, the entire disclosure of which is hereby incorporated by reference, discloses an auxiliary guide. The auxiliary guide is pivotably installed on a top portion of a housing. The auxiliary guide supports a leading end of a discharged sheet so that an operation panel is not covered.

In the above references, a user should, in advance, take the auxiliary stacker out of the main stacker or pivot the auxiliary guide to a position for guiding the leading end of the sheet.

Japanese Patent Publication No. JP09-286556, the entire disclosure of which is hereby incorporated by reference, discloses an apparatus for receiving a sheet. The apparatus comprises a sheet tray that is installed on an image forming apparatus body and a stopper. The apparatus is pivotably installed on a front end of the sheet tray to align discharged sheets. If the sheet tray is pulled out of the body to receive sheets thereon, the stopper pivots to a position to guide leading ends of the sheets. The stopper guides the leading ends of the sheets and aligns them evenly. Accordingly, the length of the sheet tray is not increased.

Accordingly, there is a need for an image forming apparatus which increases the length of a tray to prevent a sheet from falling off the tray without enlarging the footprint of the image forming apparatus.

SUMMARY OF THE INVENTION

An aspect of the present invention is to solve at least the above problems and/or disadvantages and to provide at least the advantages described below. Accordingly, an aspect of the present invention is to provide an image forming apparatus which can stably receive a discharged sheet by increasing the length of a tray without enlarging the footprint of the image forming apparatus.

According to an aspect of the present invention, there is provided an image forming apparatus comprising a printing unit having a detachable developer cartridge to print an image on a sheet using an electrophotographic process. A tray receives a sheet discharged after the completion of printing. An auxiliary tray is pivotably installed on the tray and has a first position folded over the tray and a second position to increase the length of the tray. The auxiliary tray pivots to the second position when the developer cartridge is mounted in the printing unit.

The image forming apparatus may further comprise an arm that is disposed on the auxiliary tray and an interference unit. The interference unit is disposed on the developer cartridge and pushes the arm when the developer cartridge is mounted to pivot the auxiliary tray to the second position.

It is preferable that the interference unit may elastically move backward to prevent damage to the arm when the auxiliary tray returns to the first position while the developer cartridge is mounted.

It is preferable that the arm may be coupled to a shaft of the auxiliary tray in such a manner as to pivot elastically so that the auxiliary tray is permitted to return to the first position while the developer cartridge is mounted.

It is also preferable that the auxiliary tray be inclined upward to form an angle with the tray. Thus, the discharged sheet is prevented from falling off the tray when the auxiliary tray is at the second position.

Preferably, the tray is located on a top portion of the printing unit.

According to another aspect of the present invention, there is provided an image forming apparatus comprising a printing unit to print an image on a sheet. A door is also provided to open and close one side of the printing unit. A tray is provided to receive a sheet discharged after the completion of printing is received and an auxiliary tray is pivotably installed on the tray. The auxiliary tray is movable between a first position folded over the tray and a second position to increase the length of the tray. The auxiliary tray pivots to the second position when the door is closed.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, and features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for conciseness.

Figure 1:
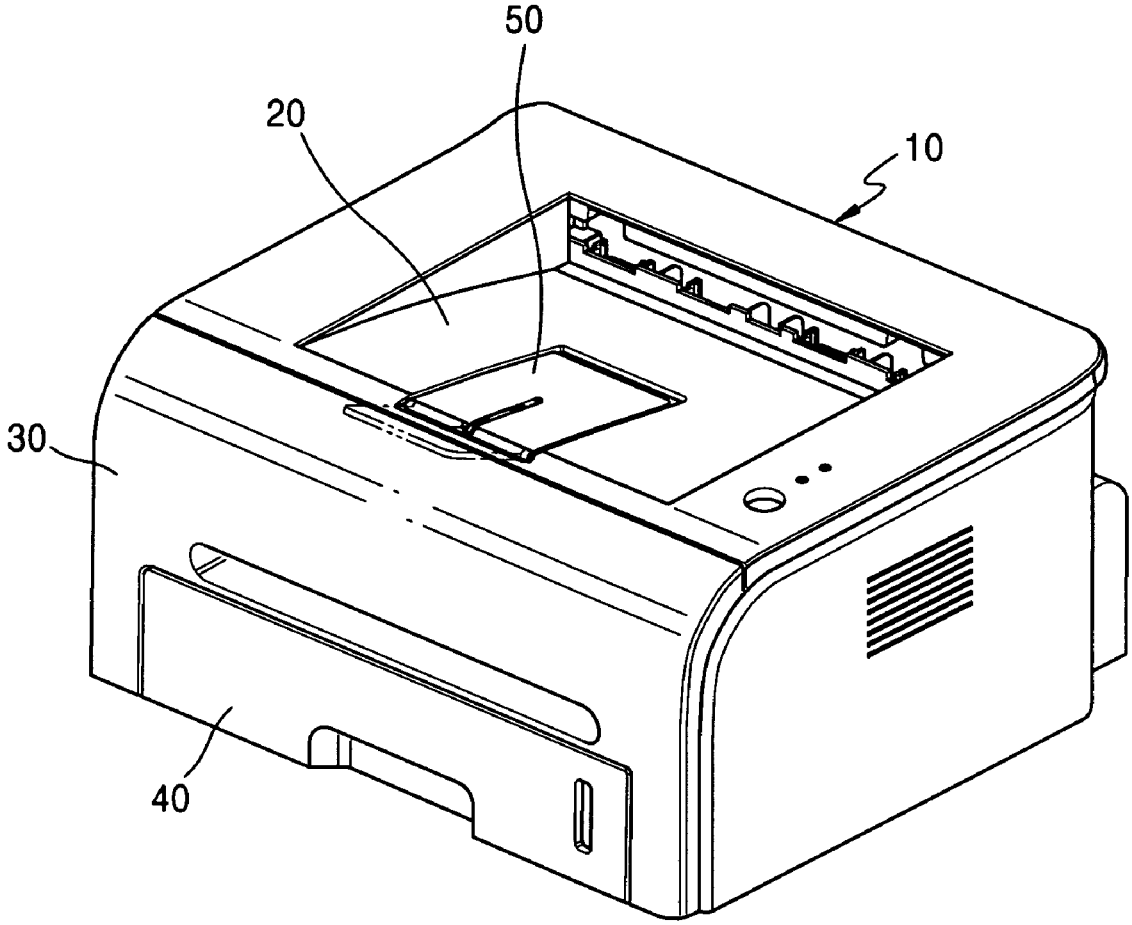
FIG. 1 is a perspective view of an image forming apparatus in accordance with an exemplary embodiment of the present invention.
Figure 2:
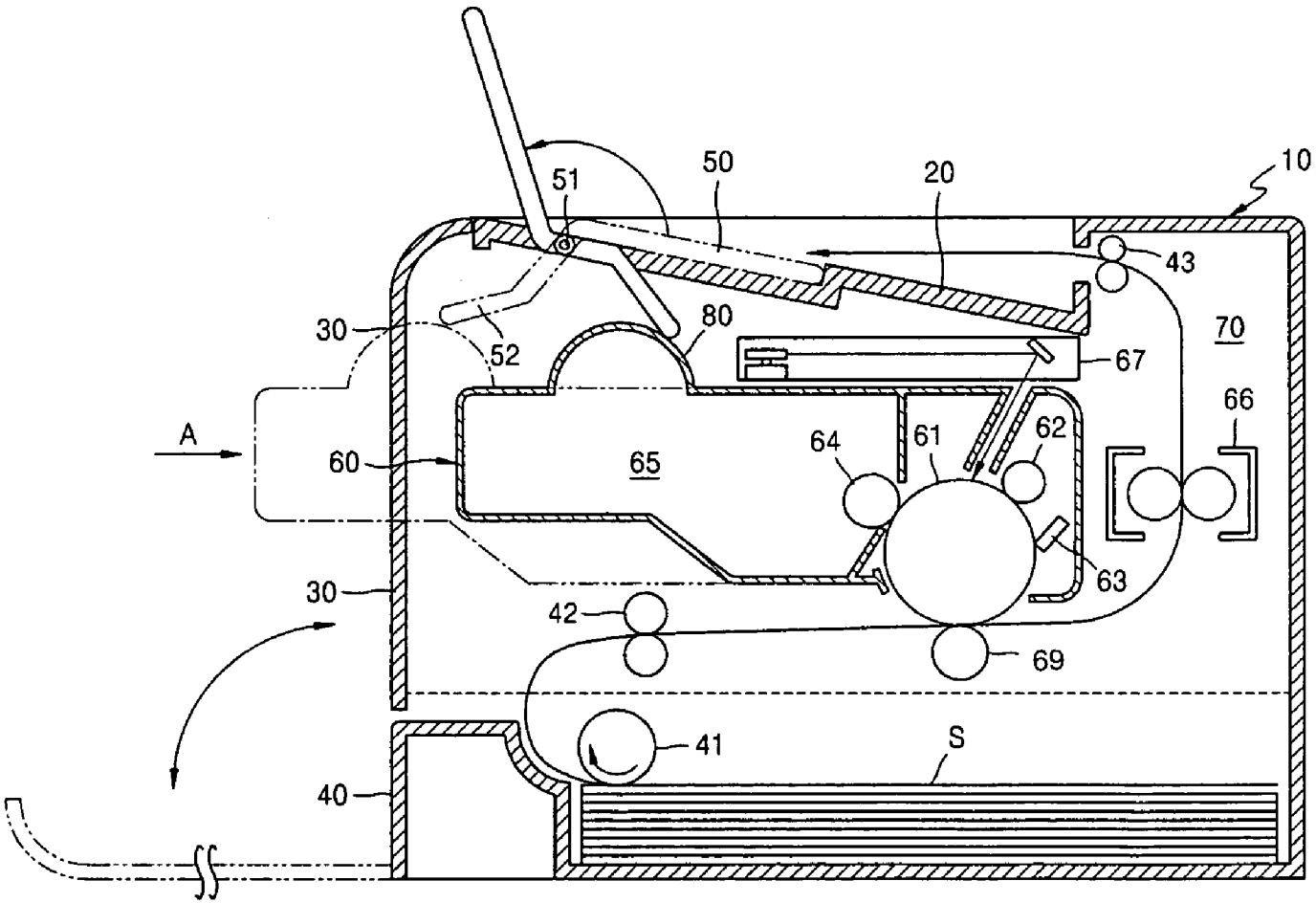
FIG. 2 is a schematic sectional view of the image forming apparatus shown in FIG. 1.

FIGS. 1-2 are respectively a perspective view and a schematic sectional view of an image forming apparatus according to an exemplary embodiment of the present invention. The image forming apparatus of the present embodiment is an apparatus that prints an image on a sheet using electrophotographic image forming technology.

Referring to FIGS. 1-2, the image forming apparatus 10 includes a printing unit 70 to perform an electrophotographic process to print an image on a sheet. The printing unit 70 includes a photosensitive drum 61, a charge roller 62, an exposure unit 67, a transfer roller 69, and a fixing unit 66.

The photosensitive drum 61 is preferably a substantially cylindrical drum-shaped body. The photosensitive drum 61 has a photoconductive layer formed on an outer peripheral surface. The charge roller 62 is a charger for charging the photosensitive drum 61 to uniform potential. A charging bias voltage is applied to the charge roller 62. While the charge roller 62 rotates into contact or out of contact with the outer peripheral surface of the photosensitive drum 61, the charge roller 62 supplies charges to the photosensitive drum 61 so that the outer peripheral surface of the photosensitive drum 61 has uniform potential. A corona discharger (not shown) may also be used as a charger instead of the charge roller 62. The exposure unit 67 forms an electrostatic latent image by emitting light corresponding to image information to the photosensitive drum 61. A laser scanning unit (LSU) uses a laser diode as a light source and is generally used as the exposure unit 67.

In a contact developing method, the developer roller 64 rotates into contact with the outer peripheral surface of the photosensitive drum 61. In a non-contact developing method, the developer roller 64 rotates leaving a predetermined developing gap from the outer peripheral surface of the photosensitive drum 61. It is preferable that the developing gap necessary for the developing process ranges from tens of microns to hundreds of microns. A developing bias voltage is applied to the developer roller 64 so that toner contained in a toner chamber 65 is supplied to the electrostatic latent image formed on the photosensitive drum 61. Thus, a toner image is formed. The transfer roller 69 faces the photosensitive drum 61. A transfer bias voltage to transfer the toner image formed on the photosensitive drum 61 to a sheet S is applied to the transfer roller 69. A cleaning blade 63 removes waste toner remaining on the outer peripheral surface of the photosensitive drum 61 after the toner image is transferred to the sheet S.

The fixing unit 66 includes a pair of rollers that are engaged and rotate under a predetermined pressure. Heating means (not shown) for heating the toner image is disposed on at least one of the pair of rollers.

The operation of the image forming apparatus, as constructed as above, will now be described. The outer peripheral surface of the photosensitive drum 61 is charged to uniform potential due to the charge roller 62. If an optical signal corresponding to the image information is emitted to the rotating photosensitive drum 61 by the exposure unit 67, a resistance of a portion to which the light is emitted is reduced so that charges attached to the outer peripheral surface of the photosensitive drum 61 are separated from the photosensitive drum 61. Accordingly, a potential difference occurs between the portion to which the light is emitted and other portions. As a result, the electrostatic latent image is formed on the outer peripheral surface of the photosensitive drum 61. When the developing bias voltage is applied to the developer roller 64, the toner contained in the toner chamber 65 is attached to the electrostatic latent image to form the toner image.

The sheet S is drawn out of a cassette 40 by a pickup roller 41 and then is conveyed by a feed roller 42. The sheet S reaches a transfer nip at the same time when a leading end of the toner image, formed on the photosensitive drum 61, reaches the transfer nip between the facing photosensitive drum 61 and transfer roller 69. When the transfer bias voltage is applied to the transfer roller 69, the toner image is transferred from the photosensitive drum 61 to the sheet S. If the sheet S to which the toner image is transferred passes through the fixing unit 66, the toner image is fixed to the sheet S due to heat and pressure. Thus printing of the image is complete.

After the completion of the image forming process, the sheet is discharged to a tray 20 by a discharge roller 43 and then is received on the tray 20. In order to reduce the footprint of the image forming apparatus the tray 20 is formed on a top portion of the printing unit 70. That is the exterior framework of the image forming apparatus. As image forming apparatuses are minimized in size, the length of the tray 20 is becoming shorter than the length of the sheet S. Therefore, embodiments of the present invention provide an auxiliary tray 50 that is pivotably installed on the tray 20 to increase the length of the tray 20. The auxiliary tray 50 has a first position folded over the tray 20 and a second position to increase the length of the tray 20.

In general, the photosensitive drum 61 and the toner chamber 65 are enclosed in a cartridge unit. The image forming apparatus includes a developer cartridge 60 having the toner chamber 65, the photosensitive drum 61, and the developer roller 64 integrally formed. The developer cartridge 60 further includes the charge roller 62 and the cleaning blade 63. The developer roller 64 and the toner chamber 65 are preferably integrally formed and enclosed in the developer cartridge 60, or the photosensitive drum 61 may be provided as a separate unit. The developer cartridge 60 may further include a supply roller (not shown) for attaching toner to the developer roller 64, a regulation unit (not shown) for regulating the amount of toner attached to the developer roller 64, and an agitator (not shown) for conveying the toner contained in the toner chamber 65 to the supply roller and/or the developer roller 64.

A door 30 is used to mount or separate the developer cartridge 60 in or from the printing unit 70. That is, the door 30 is opened to open one side of the printing unit 70 and the developer cartridge 60 is mounted in or separated from the printing unit 70 through the opened side.

The image forming apparatus of the present embodiment is characterized in that when the developer cartridge 60 is mounted in the printing unit 70, the auxiliary tray 50 pivots from the first position to the second position. That is, the auxiliary tray 50 is operatively connected to the developer cartridge 60 so that the auxiliary tray 50 pivots to the second position when the developer cartridge 60 is mounted. As shown in FIG. 2, an arm 52 is disposed on the auxiliary tray 50, and an interference unit 80 is disposed on the developer cartridge 60 to pushing the arm 52 when the developer cartridge 60 is mounted. For example, the arm 52 may extend downwardly from a shaft 51 of the auxiliary tray 50. The interference unit 80 may be disposed on a top surface of the developer cartridge 60.

In this above structure, if the door 30 is opened and the developer cartridge 60 is pushed in an arrow direction A shown in FIG. 2, the interference unit 80 pushes the arm 52 so that the auxiliary tray 50 pivots to the second position. Then, the length of the tray 20 increases by the length of the auxiliary tray 50. It is preferable that the auxiliary tray 50 is inclined upward to form an angle with the tray 20 as shown in FIG. 2. Thus, the sheet is prevented from falling off the tray 20 when the auxiliary tray 50 is at the second position. Accordingly, discharged sheets may be effectively stacked on the tray 20 without increasing the footprint of the image forming apparatus. Moreover, problems that are caused when the length of the tray is reduced may be solved. Further, the developer cartridge 60 must be mounted in the printing unit 70 to perform printing. According to the image forming apparatus of the present embodiment, the auxiliary tray 50 automatically pivots to the second position when the developer cartridge 60 is mounted in the printing unit 70. Accordingly, a user does not need to manually shift the auxiliary tray 50 to the second position, thereby solving a problem that the user forgets to shift the auxiliary tray 50 to the second position and prevents the sheet from falling off the tray 20.

It is preferable that the auxiliary tray 50 be permitted to return to the first position while the developer cartridge 60 is mounted in the printing unit 70. If it is not permitted to do so, the arm 52 may be damaged when an external force for pivoting the auxiliary tray 50 to the first position is applied to the auxiliary tray 50.

Figure 3:
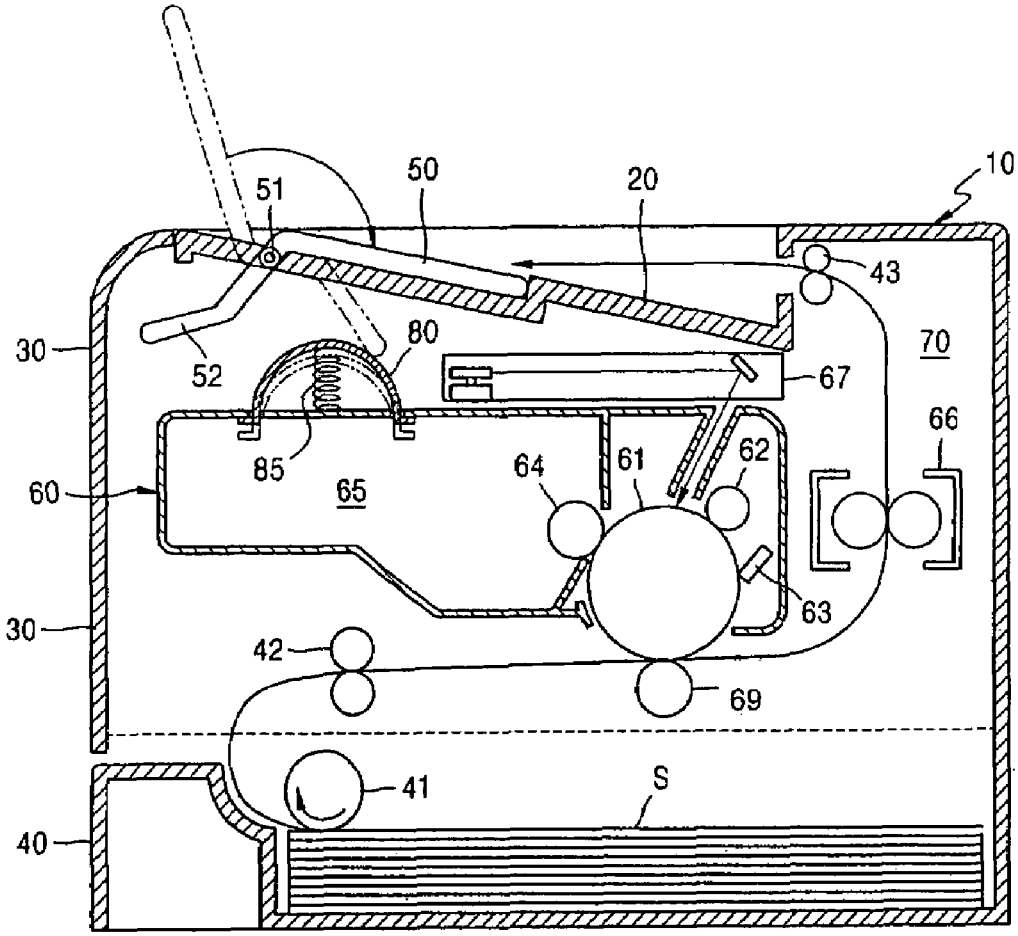
FIG. 3 is a sectional view of a modified example of the image forming apparatus shown in FIG. 1.

For example, as shown in FIG. 3, the interference unit 80 may be supported by an elastic member 85. If an external force for pivoting the auxiliary tray 50 to the first position is applied to the auxiliary tray 50, while the developer cartridge 60 is mounted, the arm 52 pushes the interference unit 80. Thus, the interference unit 80 elastically moves backward as shown by the dotted line, and then returns to its original position after interference with the arm 52 is removed.

Figure 4:
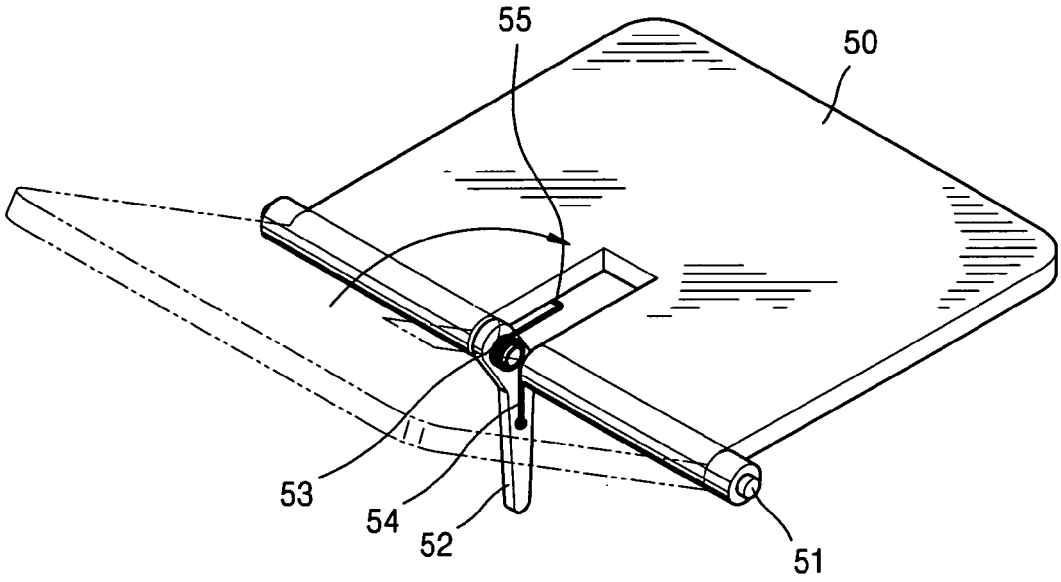
FIG. 4 is a sectional view of another modified example of the image forming apparatus shown in FIG. 1.

For another example, the arm 52 may be installed on the auxiliary tray 50 in such a manner so as to pivot elastically. Referring to FIG. 4, the arm 52 is pivotably installed on a shaft 51 of the auxiliary tray 50. A torsion spring 53 is inserted into the shaft 51 and has one end 54 supported on the arm 52. The other end 55 is supported on the auxiliary tray 50. In this structure, if an external force for pivoting the auxiliary tray 50 to the first position is applied to the auxiliary tray 50, while the developer cartridge 60 is mounted, the auxiliary tray 50 pivots to the first position by elastically deforming the coil spring 53. If the external force is removed, the auxiliary tray 50 returns to the second position due to the elastic force of the coil spring 53.

Figure 5:
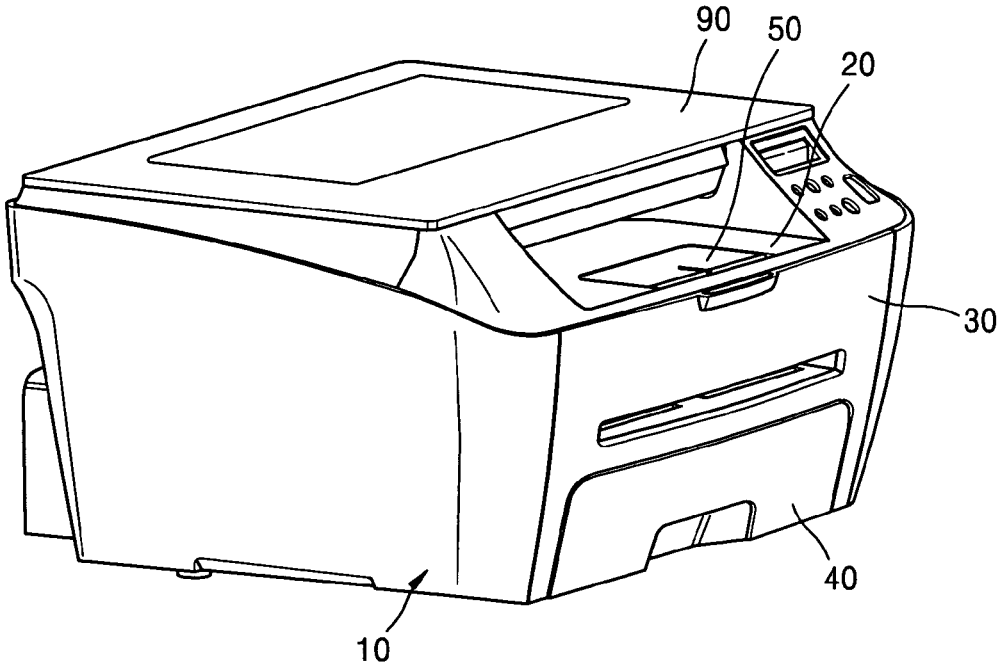
FIG. 5 is a perspective view of an applied example of the image forming apparatus in accordance with an embodiment of the present invention.

The image forming apparatus in accordance with embodiments of the present invention is not limited to a printer. As shown in FIG. 5, the image forming apparatus may also be applied to a multi-function machine on which a scanning unit 90 to read an image from a manuscript is mounted. The structure of the scanning unit 90 is well known to one of ordinary skill in the art, and accordingly, a detailed explanation thereof is omitted for clarity and conciseness. Referring to FIG. 5, the scanning unit 90 is installed above the tray 20. A discharged sheet with a printed image thereon is received in a space between the tray 20 and the scanning unit 90. The auxiliary tray 50 is installed on the tray 20. The auxiliary tray 50 pivots to the second position when the developer cartridge 60 is mounted in the structure shown in FIGS. 2-4.

Figure 6:
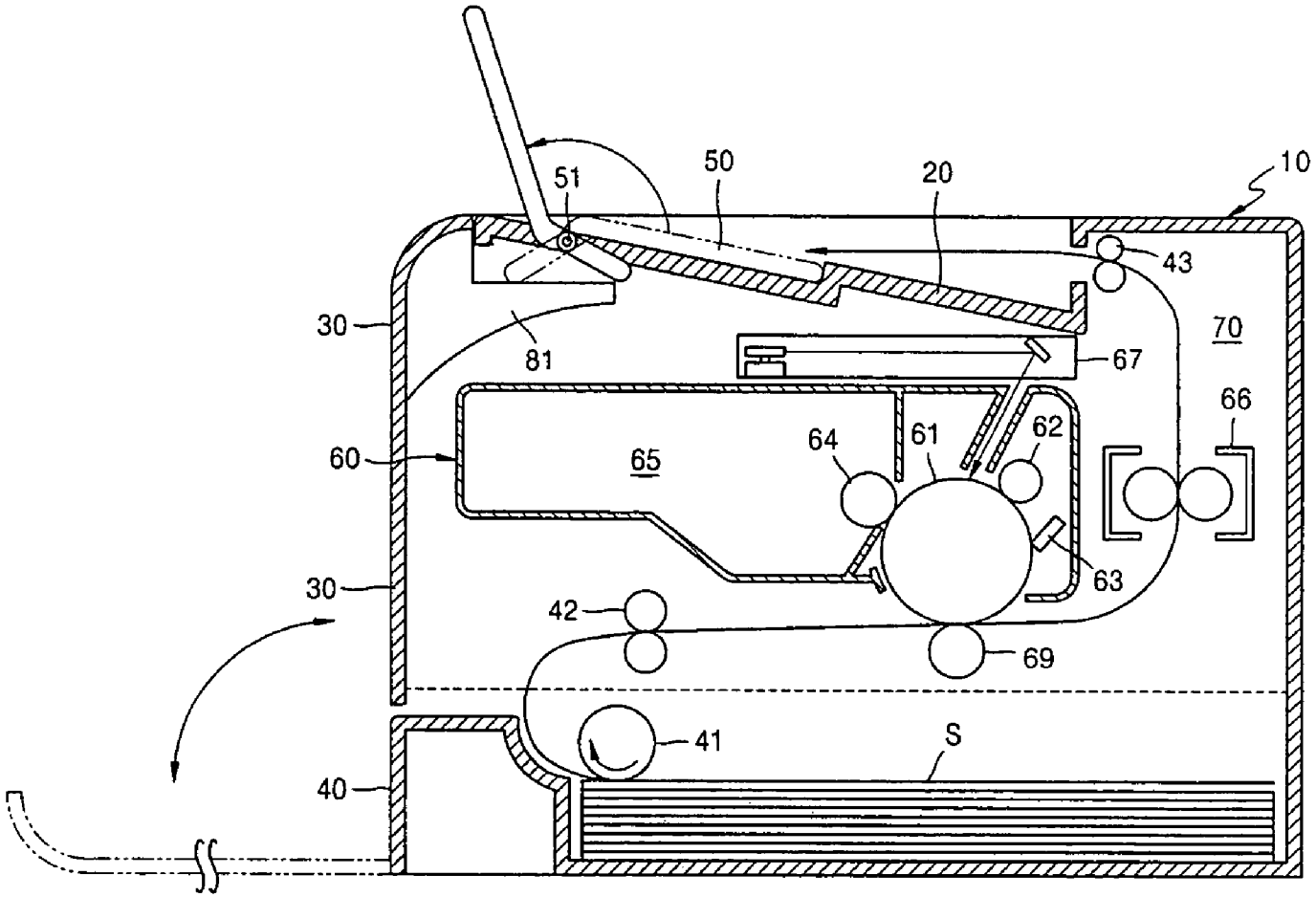
FIG. 6 is a schematic sectional view of an image forming apparatus according to another exemplary embodiment of the present invention.

FIG. 6 is a sectional view of an image forming apparatus according to another exemplary embodiment of the present invention. The image forming apparatus is characterized in that the auxiliary tray 50 is operatively connected to the door 30 so that the auxiliary tray 50 pivots to the second position when the door 30 is closed. Referring to FIG. 6, the arm 52 downwardly extends from the shaft 51 of the auxiliary tray 50. An interference unit 81 for pushing the arm 52 is disposed on the door 30. In this structure, if the door 30 is closed, the interference unit 81 pushes the arm 52 so that the auxiliary tray 50 pivots to the second position. Then, the length of the tray 20 increases by the length of the auxiliary tray 50. Accordingly, the same effect can be achieved as in the embodiment illustrated in FIGS. 1-2. It is preferable that the auxiliary tray 50 is inclined upward to form an angle with the tray 20 as shown in FIG. 6. Consequently, the sheet is prevented from falling off the tray 20 when the auxiliary tray 50 is at the second position.

Figure 7:
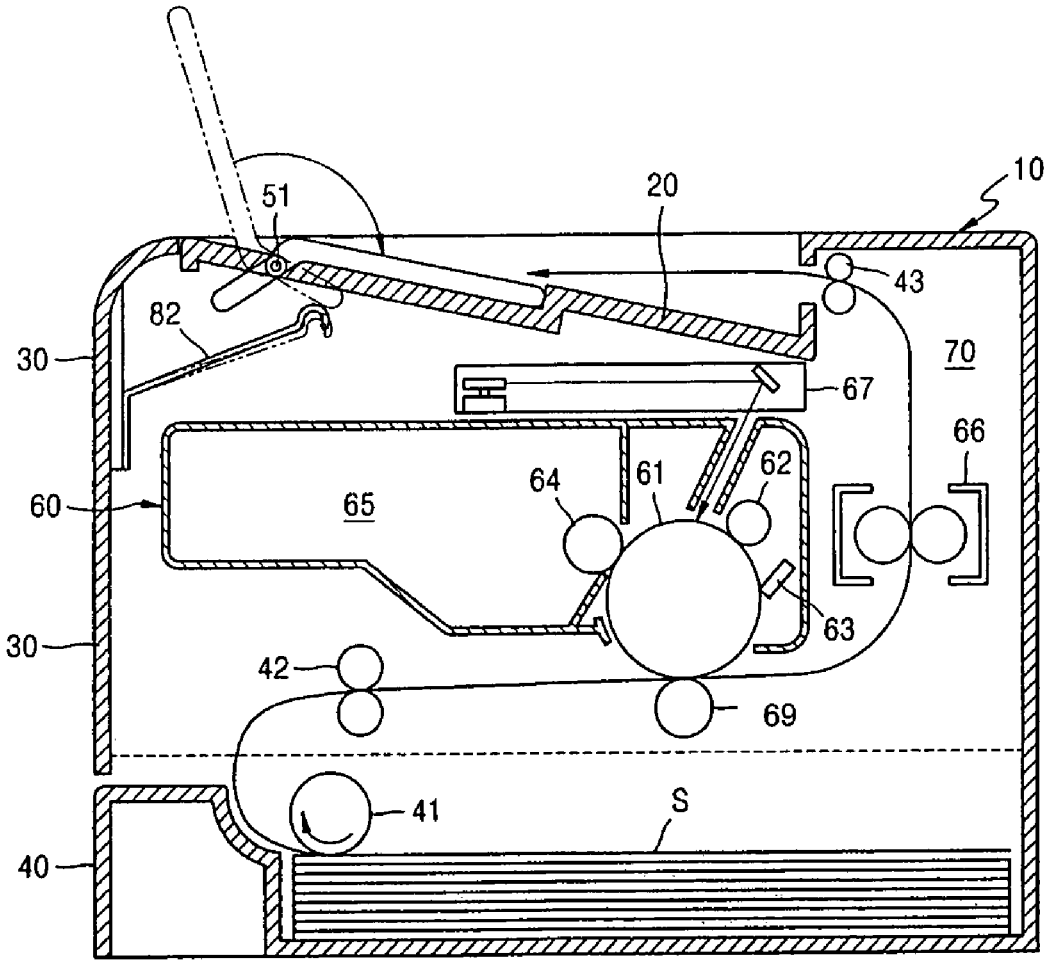
FIG. 7 is a sectional view of a modified example of the image forming apparatus shown in FIG. 6.

For example, as shown in FIG. 7, to prevent damage to the arm 52, an interference unit 82 may elastically move backward during an interference with the arm 52. The interference unit 82 may be made of an elastic material and coupled to the door 30. In the above structure, if an external force for pivoting the auxiliary tray 50 to the first position is applied to the auxiliary tray 50 while the door 30 is closed, the arm 52 pushes the interference unit 82. Therefore, the interference unit 82 elastically moves backward (FIG. 7) and then returns to its original position after the interference with the arm 52 is removed. As shown in FIG. 4, in order to prevent the arm 52 from being damaged, the arm 52 may also be installed on the shaft 51 of the auxiliary tray 50 so that the arm 52 can pivot elastically.

The image forming apparatus according to the present invention is not limited to the image forming apparatus illustrated in FIGS. 6-7 that uses the electrophotographic process and other suitable arrangements and constructions may be used. The image forming apparatus according to the present invention is not restricted by a printing method, and the present invention can be applied to any image forming apparatus having a door through which the inside of the image forming apparatus may be accessed.

As described above, the image forming apparatus according to the present invention has the following effects.

First, since the length of the tray on which the discharged sheet is received may be increased effectively without enlarging the footprint of the image forming apparatus, problems associated with minimizing the length of the tray may be solved.

Second, the auxiliary tray pivots automatically to increase the length of the tray whenever the developer cartridge is mounted or the door is closed. Therefore, the problem of having the discharged sheet fall off the tray may also be solved.

While the invention has been shown and described with reference to certain embodiments thereof, it will be understood by those skilled in the art that various changes in form and details may be made therein without departing from the spirit and scope of the invention as defined by the appended claims.

What is claimed is:

1. An image forming apparatus comprising:

a printing unit to print an image on a sheet;

a door to open and close one side of the printing unit;

a tray to receive a sheet discharged after the completion of printing;

an auxiliary tray being pivotably installed on the tray, the auxiliary tray movable between a first position folded over the tray and a second position to increase the length of the tray;

an arm disposed on the auxiliary tray; and an interference unit disposed on the door, the interference unit being configured to push the arm when the door is closed to pivot the auxiliary tray to the second position;

wherein the auxiliary tray pivots to the second position when the door is closed; and the interference unit elastically moves backward to prevent damage to the arm when the auxiliary tray returns to the first position while the door is closed.

2. The image forming apparatus of claim 1, wherein the printing unit includes a detachable developer cartridge to print the image on the sheet using an electrophotographic process.

3. The image forming apparatus of claim 1, wherein the auxiliary tray is inclined upward to form an angle with the tray so that the discharged sheet is prevented from falling off the tray when the auxiliary tray is at the second position.

4. The image forming apparatus of claim 1, wherein the tray is located on a top portion of the printing unit.

5. An image forming apparatus, comprising:

a printing unit having a detachable developer cartridge to print an image on a sheet using an electrophotographic process;

a door to open and close one side of the printing unit;

a tray to receive a sheet discharged after the completion of printing;

an auxiliary tray pivotably installed on the tray, the auxiliary tray being movable between a first position folded over the tray and a second position to increase a length of the tray;

an arm disposed on the auxiliary tray; and an interference unit disposed on one of the developer cartridge and the door, the interference unit being configured to push the arm to pivot the auxiliary tray to the second position when the one of the developer cartridge and the door is respectively mounted in the printing unit or closed;

wherein the auxiliary tray pivots to the second position when one of the developer cartridge is mounted in the printing unit and the door is closed; and the interference unit elastically moves backward to prevent damage to the arm when the auxiliary tray returns to the first position while the one of the developer cartridge and door is respectively mounted in the printing unit or closed.

6. The image forming apparatus of claim 5, wherein the auxiliary tray is inclined upward to form an angle with the tray so that the discharged sheet is prevented from falling off the tray when the auxiliary tray is at the second position.

7. The image forming apparatus of claim 5, wherein the tray is located on a top portion of the printing unit.

8. An image forming apparatus comprising:

a printing unit to print an image on a sheet;

a door to open and close one side of the printing unit;

a tray to receive a sheet discharged after the completion of printing;

an auxiliary tray being pivotably installed on the tray, the auxiliary tray movable between a first position folded over the tray and a second position to increase the length of the tray;

an arm disposed on the auxiliary tray; and an interference unit disposed on the door, the interference unit being configured to push the arm when the door is closed to pivot the auxiliary tray to the second position;

wherein the auxiliary tray pivots to the second position when the door is closed; and the arm is coupled to a shaft of the auxiliary tray in such a manner so as to pivot elastically so that the auxiliary tray is permitted to return to the first position while the door is closed.

9. An image forming apparatus, comprising:

a printing unit having a detachable developer cartridge to print an image on a sheet using an electrophotographic process;

a door to open and close one side of the printing unit;

a tray to receive a sheet discharged after the completion of printing;

an auxiliary tray pivotably installed on the tray, the auxiliary tray being movable between a first position folded over the tray and a second position to increase a length of the tray;

an arm disposed on the auxiliary tray; and an interference unit disposed on one of the developer cartridge and the door, the interference unit being configured to push the arm to pivot the auxiliary tray to the second position when the one of the developer cartridge and the door is respectively mounted in the printing unit or closed;

wherein the auxiliary tray pivots to the second position when one of the developer cartridge is mounted in the printing unit and the door is closed; and the arm is coupled to a shaft of the auxiliary tray to pivot elastically so that the auxiliary tray is permitted to return to the first position while the one of the developer cartridge and door is respectively mounted in the printing unit or closed.

* * * * *